US010179973B2

(12) United States Patent
Keinberger et al.

(10) Patent No.: US 10,179,973 B2
(45) Date of Patent: Jan. 15, 2019

(54) SEALING-STRIP HOLDER

(71) Applicant: ROCHLING LERIPA PAPERTECH GMBH & CO. KG, Osterreich (AU)

(72) Inventors: Rudiger Keinberger, Osterreich (AT); Peter Eckerstorfer, Osterreich (AT); Markus Ecker, Osterreich (AT); Anton Luger, Osterreich (AT)

(73) Assignee: ROCHLING LERIPA PAPERTECH GMBH & CO. KG, Osterreich (AT)

( * ) Notice: Subject to any disclaimer, the term of this patent is extended or adjusted under 35 U.S.C. 154(b) by 0 days.

(21) Appl. No.: 15/511,011

(22) PCT Filed: Sep. 14, 2015

(86) PCT No.: PCT/AT2015/050229
§ 371 (c)(1),
(2) Date: Mar. 13, 2017

(87) PCT Pub. No.: WO2016/040975
PCT Pub. Date: Mar. 24, 2016

(65) Prior Publication Data

US 2017/0254020 A1 Sep. 7, 2017

(30) Foreign Application Priority Data

Sep. 15, 2014 (AT) ..... A50641/2014
Jul. 24, 2015 (AT) ..... A50655/2015

(51) Int. Cl.
*D21F 3/10* (2006.01)
*D21F 3/02* (2006.01)

(52) U.S. Cl.
CPC ..... *D21F 3/10* (2013.01); *D21F 3/02* (2013.01); *D21F 3/0281* (2013.01)

(58) Field of Classification Search
CPC ..... D21F 3/10; D21F 7/00; D21F 1/50; F16C 13/00; F16J 15/162; D21G 1/02
See application file for complete search history.

(56) References Cited

U.S. PATENT DOCUMENTS 2,312,519 A * 3/1943 Berry ..... D21F 3/10 162/371
2,578,551 A * 12/1951 Horn ..... D21F 3/10 162/371
5,580,424 A * 12/1996 Snellman ..... D21F 3/10 162/368
6,241,854 B1 * 6/2001 Frawley, Jr. ..... D21F 3/10 162/371

(Continued)

FOREIGN PATENT DOCUMENTS

AT 516191 B1 * 8/2016 ..... D21F 3/10
AT 516210 B1 * 4/2017 ..... D21F 3/10

(Continued)

OTHER PUBLICATIONS

Machine Translation of WO 2013/167656 A1 (Year: 2013).*

*Primary Examiner* — Jose A Fortuna
(74) *Attorney, Agent, or Firm* — FisherBroyles LLP; Anthony Dovale

(57) ABSTRACT

Sealing strip holder for suction rolls used for dewatering of sheeting e.g. for paper machines comprises a roll shell with openings and disposed within at least one suction box.

20 Claims, 3 Drawing Sheets

(56) References Cited

U.S. PATENT DOCUMENTS

Figure 1:
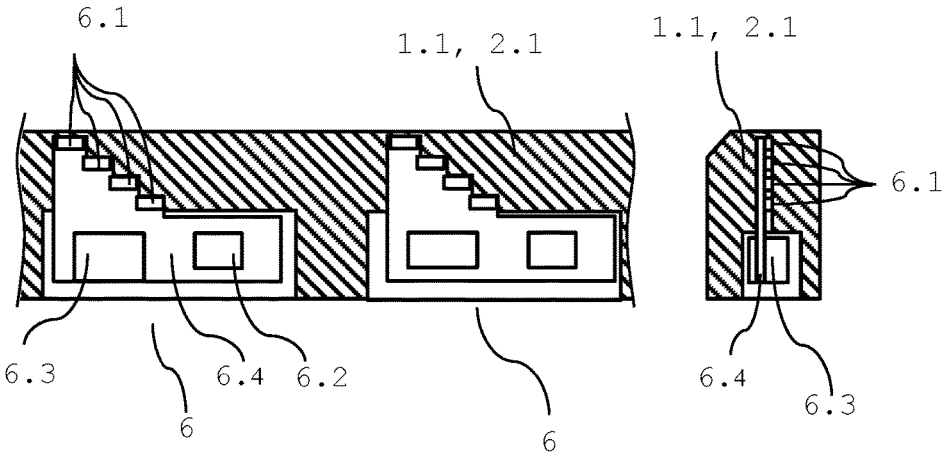

| | | | | |
|---|---|---|---|---|
| 6,302,399 | B1 * | 10/2001 | Prinzing | D21F 1/483 162/371 |
| 6,334,934 | B1 * | 1/2002 | Heinzmann | D21F 3/10 162/367 |
| 6,436,241 | B1 * | 8/2002 | Persson | D21F 3/10 162/272 |
| 7,090,219 | B2 * | 8/2006 | Schrefl | D21F 3/10 162/371 |
| 7,144,477 | B2 * | 12/2006 | Gleason, Jr. | D21F 3/10 162/198 |
| 7,569,265 | B2 * | 8/2009 | Boga | C09K 3/10 162/369 |
| 9,447,542 | B2 * | 9/2016 | Erkelenz | D21F 1/50 |
| 9,650,743 | B2 * | 5/2017 | Erkelenz | D21F 7/00 |
| 9,708,768 | B2 * | 7/2017 | Erkelenz | D21F 3/10 |
| 2002/0060030 | A1 * | 5/2002 | Heinzmann | D21F 3/10 162/270 |
| 2002/0175477 | A1 * | 11/2002 | Schrefl | D21F 3/10 277/552 |
| 2003/0051849 | A1 * | 3/2003 | Ehrola | D21F 3/10 162/368 |
| 2004/0168603 | A1 * | 9/2004 | Boga | C09K 3/10 101/494 |
| 2004/0195779 | A1 * | 10/2004 | Schrefl | D21F 3/10 277/549 |
| 2005/0126732 | A1 * | 6/2005 | Gleason, Jr. | D21F 3/10 162/198 |
| 2009/0000753 | A1 * | 1/2009 | Vestola | D21F 3/10 162/371 |
| 2015/0184340 | A1 * | 7/2015 | Erkelenz | D21F 3/10 162/374 |
| 2015/0191872 | A1 * | 7/2015 | Erkelenz | D21F 3/10 277/500 |
| 2015/0204014 | A1 * | 7/2015 | Erkelenz | D21F 3/10 277/300 |
| 2016/0153141 | A1 * | 6/2016 | Erkelenz | D21F 3/10 162/373 |
| 2017/0159818 | A1 * | 6/2017 | Erkelenz | F16J 15/162 |
| 2017/0254019 | A1 * | 9/2017 | Keinberger | D21F 3/02 |
| 2017/0254020 | A1 * | 9/2017 | Keinberger | D21F 3/10 |
| 2018/0017162 | A1 * | 1/2018 | Erkelenz | F16C 13/00 |
| 2018/0119355 | A1 * | 5/2018 | Erkelenz | D21D 5/023 |

FOREIGN PATENT DOCUMENTS

| | | | | | |
|---|---|---|---|---|---|
| DE | 10325686 | A1 * | 12/2004 | | D21F 3/10 |
| DE | 102004059028 | A1 * | 6/2006 | | D21F 3/10 |
| DE | 102004062107 | A1 * | 7/2006 | | D21F 3/10 |
| DE | 102005052552 | A1 * | 5/2007 | | D21F 3/10 |
| DE | 102012208811 | B3 * | 7/2013 | | D21F 3/10 |
| DE | 102012207692 | A1 * | 11/2013 | | D21F 3/10 |
| DE | 102012213544 | A1 * | 2/2014 | | D21F 3/10 |
| EP | 0738801 | A2 * | 10/1996 | | D21F 3/10 |
| EP | 1239076 | A2 * | 9/2002 | | D21F 3/10 |
| EP | 1479820 | A1 * | 11/2004 | | D21F 3/10 |
| EP | 2847381 | B1 * | 8/2016 | | D21F 3/10 |
| GB | 778779 | A * | 7/1957 | | D21F 3/10 |
| WO | WO-2007003698 | A1 * | 1/2007 | | D21F 3/10 |
| WO | WO-2013167656 | A1 * | 11/2013 | | D21F 3/10 |
| WO | WO-2016040975 | A1 * | 3/2016 | | D21F 3/10 |

* cited by examiner

SEALING-STRIP HOLDER

FIELD OF INVENTION

The present invention relates to sealing strip holder for suction rolls.

BACKGROUND OF THE INVENTION

A suction roll used for dewatering of sheeting e.g. for paper machines comprises a roll shell with openings and disposed within at least one suction box. The suction box is arranged stationary on the inside of the suction roll with the holey roll shell rotating around the suction box. To seal the suction box from the roll shell, said roll shell comprises lateral sealing strips which seal the inside of the suction box from the remaining volume of the suction roll, preferably in longitudinal direction of the suction roll. The suction box is delimited on both ends in peripheral direction of the suction roll by edge deckles and sealed from the roll shell.

A particular challenge in the construction or operation of suction rollers is the supply of lubrication water to reduce heat development and wear on the sealing strip.

WO 2013167656 A1 discloses the provision of a spray tube before each sealing strip used in the suction roll, in which each spray tube has its own supply line. The same is already known from DE 1005825 B of 1957. The disadvantage of the introduction in front of the sealing strip by means of additional spray pipes is the additional space requirement in the suction roll and the higher installation costs. A disadvantage of the known suction pipes within the suction zone is that they reduce the suction zone on the one hand and thus reduce the efficiency of the suction roll and on the other hand, the vacuum prevailing in the suction zone extracts a considerable amount of the lubrication water before this reaches the sealing strip.

WO 2013167656 A1 further discloses the provision of the supply of the lubricant in the sealing strip, which can also be taken from WO2014026913 (A1). The supply of the lubrication water in the sealing strip is disadvantageous for several reasons. First, the friction surface of the sealing strip is reduced by the openings of the lubrication water supply, secondly the openings of the lubricating water supply wear out visibly, thirdly the sealing strip designed as a wearing part is complex in the manufacture and thus more expensive, fourthly, the holder itself becomes more complicated, fifthly with sealing strips movable in the sealing strip holder, as they are customary according to the state of the technology, the transition from the sealing strip holder into the sealing strip is difficult, as a result of which the assembly and sealing of the lubrication water system is complex, sixthly the lubrication groove or the openings in the sealing strip can be sealed by impurities, fibers or chemicals, which would cause a local increase in wear and temperature, which in turn can lead to damage to the sealing strip or roll.

BRIEF SUMMARY OF THE INVENTION

The objective of the present invention is to make the introduction of the lubrication water simple, space-saving and purpose-oriented.

According to the invention, the lubricant supply is provided to be integrated into the sealing strip holder as an improvement over the prior art.

Thus, the lubricant water can be inserted very close to the friction surface, therefore the surface, with which the sealing strip grates against the roll shell as well as the space requirement can be reduced in comparison to a spray tube mounted in front of the sealing strip mounting. In addition, the lubricant quantity can be reduced by the targeted introduction close to the sealing strip, whereby advantageously the otherwise enormous water consumption of the sealing strip is lowered. Compared to a lubricating water system, which is integrated into the sealing strip, inter alia, the advantages result from the fact that the friction surface is not reduced by the openings of the lubrication water supply and that the sealing strip has a simpler design.

The inventive device thus consists of a suction roll, in the interior of which a suction box is attached, which is laterally delimited by sealing strips. At least one lubrication water supply is assigned to a sealing strip, which feeds in the direction of the inside of the perforated casing of the suction roll in the running direction viewed in front of the sealing strip of lubrication liquid, wherein the lubrication water supply is integrated into the sealing strip holder. Each sealing strip preferably has an actuator, by means of which the surface pressure of the sealing strip can be changed to the inner shell surface of the suction roll. The second rear sealing strip seen in the running direction preferably also has a second actuator, by means of which the opening angle of the gap between the sealing strip and the suction drum shell can be varied. The second, rear sealing strip seen in the running direction preferably has an electroacoustic transducer which is preferably integrated into the holder of the sealing strip and is thus protected from moisture. The temperature sensors, which preferably also serve for the wear measurement in addition to the temperature measurement, are preferably installed in the sealing strips. It is preferred to process the data of the sensors in a miniserver and to actuate the actuators through the miniserver. A miniserver is a miniaturized data processing system with input and output modules and possibilities for digital communication, in particular for wireless communication with input and output devices and other data processing systems of a network.

Preferably, a flow sensor, which is in data communication with the miniserver, is provided in the lubricant supply or in the line leading to the lubricant supply to monitor or measure the amount of used spray water in real-time. The flow rate is preferably controlled or controlled by the miniserver, for example, by adjusting at least one valve.

In a preferred method according to the invention, it is suggested to measure the temperature of the sealing strip for optimized use of lubricant and to control and/or regulate the lubricant water usage and/or lubricant water amount on the basis of the measured temperature. For this the temperature can be measured in one or several points of the sealing strip and the amount of lubricant inserted along the length of the sealing strip can be consistent in each area of the sealing strip.

If the temperature of the sealing strip is measured in several areas of the sealing strip, the local temperature curve in the sealing strip can be determined. Preferably, the inserted amount of lubricant can be controlled and/or regulated separately in each individual area of the longitudinal extent of the sealing strip, thus enabling the insertion of lubricant water only into the affected area in case of local heat production in the sealing strip.

Since, by the introduction of lubricating water, material adhering to the sealing strip is also swept away, temperature increases caused by such impurities can be reacted by flushing the adhering material by increasing the flow of lubricating water.

Due to the heat production in the sealing strip as a result of friction on the inner shell surface of the suction roll and the reduction of said friction by the lubricant water, the required lubricant water amount can thus be inserted exactly, said lubricant water amount is necessary to keep the friction and thus abrasion low.

For the above described method it is necessary to determine, as closely as possible to the surface, the temperature of the sealing strip, with which the sealing strip grates against the inner shell surface of the suction roll. For this purpose, it is preferable to mount the temperature sensor on the inside of the sealing strip, according to DE102007027688 A1. The distance between the temperature sensors of DE102007027688 A1 and said surface should thereby be high enough so that these remain integrated into the material of the sealing strip until the maximum permitted abrasion is reached.

The inventive improvement proposes integration of several temperature sensors into the sealing strip with implementation and/or integration of these temperature sensors into the sealing strip with varying depths. More preferable is thus that the temperature sensors can also be used for monitoring and/or measuring abrasion.

This occurs through breakage of the temperature sensors as soon as they are no longer protected by the material of the sealing strips and wear out at the suction roll.

Several such temperature sensors are always preferable that are displaced in staggered depthwise manner combined in a sensor unit with mounting of preferably several such sensor units distributed along the longitudinal direction of the sealing strip. Thus the local temperature curve in the sealing strip and the local abrasion of the sealing strip can be monitored and/or this data can be transmitted to a control or regulation unit.

The lubricating water or the lubricant can actually be water or another liquid, in particular, further liquids or additives may be added to the water.

BRIEF DESCRIPTION OF THE SEVERAL DRAWINGS OF THE INVENTION

The invention provides for drawings for illustration purposes:

FIG. 1: Shows the design of an inventive sealing strip with inventive temperature sensors with abrasion detection.

Figure 2:
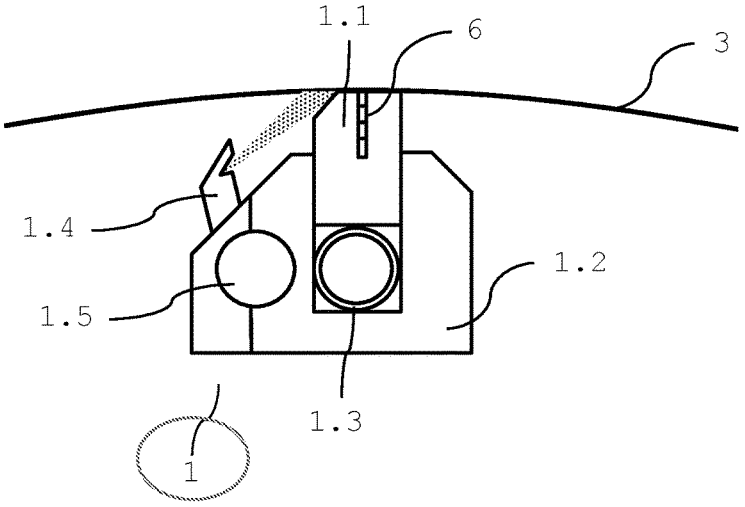

FIG. 2: Shows schematically an example of an inventive sealing strip system.

Figure 3:
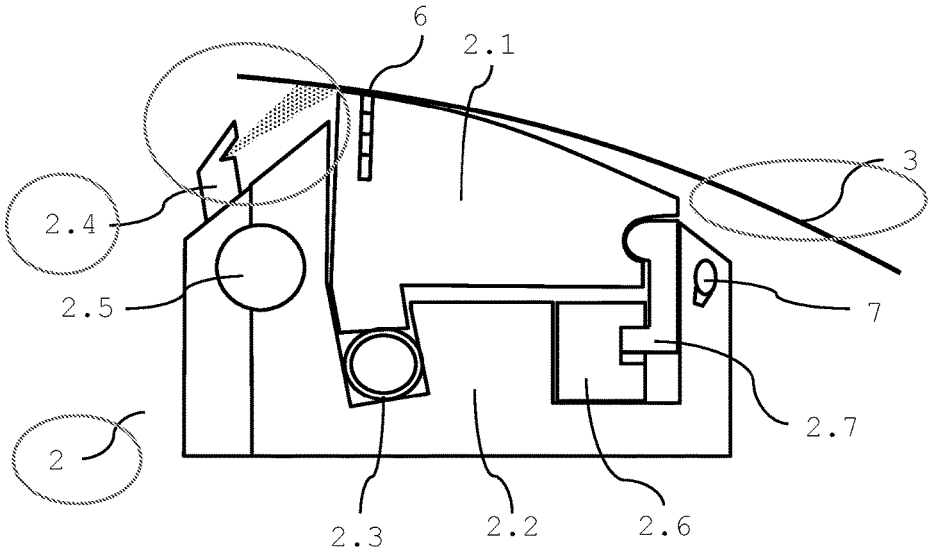

FIG. 3: Shows schematically an example of an inventive sealing strip system in a noise reducing embodiment.

Figure 4:
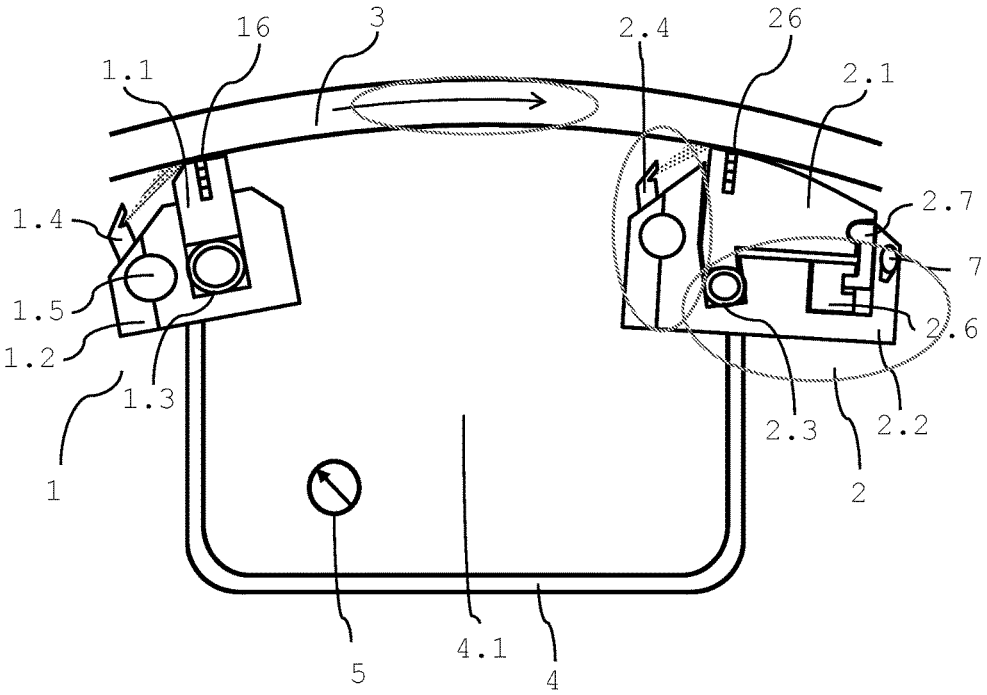

FIG. 4: Shows schematically a particularly preferred inventive sealing apparatus of a suction roll.

Figure 5:
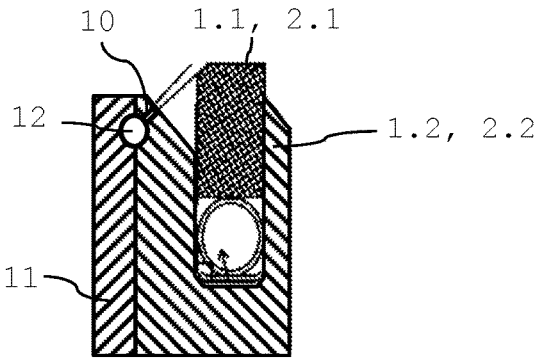

FIG. 5: Shows schematically an example of an inventive sealing strip holder with sealing strip in cross-section.

Figure 6:
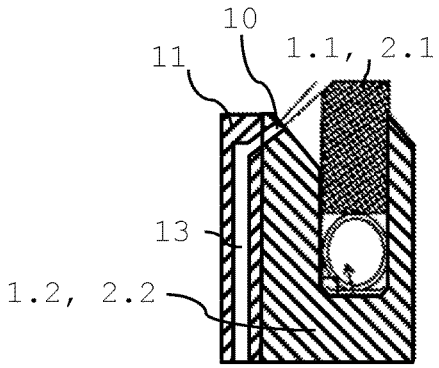

FIG. 6: Shows schematically a further example of an inventive sealing strip holder with sealing strip in cross-section.

Figure 7:
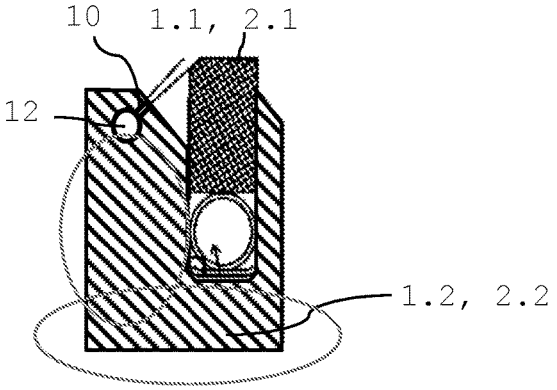

FIG. 7: Shows schematically a further example of an inventive sealing strip holder with sealing strip in cross-section.

Figure 8:
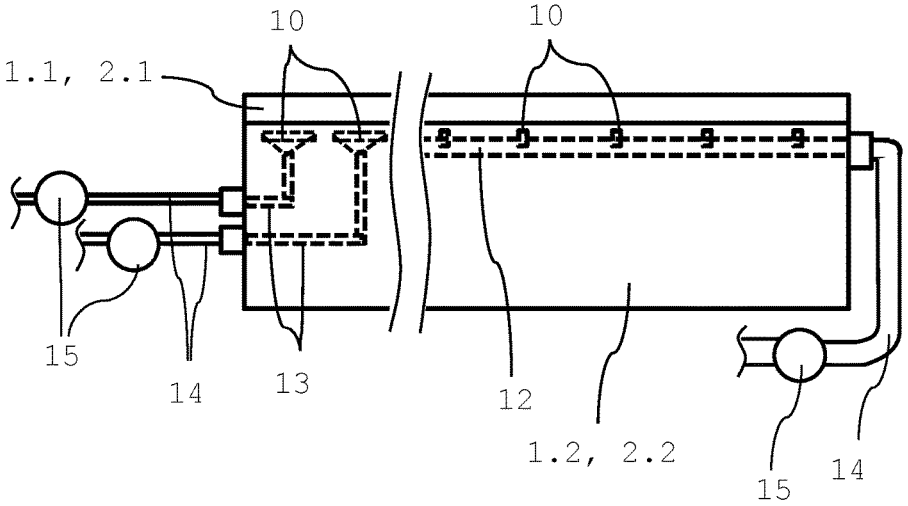

FIG. 8: Shows schematically an further example of an inventive sealing strip holder with sealing strip in cross-section in the direction of movement of the suction roll shell seen from the front.

DETAILED DESCRIPTION OF THE INVENTION

FIG. 1 shows the inventive sealing strip 1.1, 2.1 with integrated temperature sensors 6.1. In this preferred embodiment, several sensor units 6 are integrated into the sealing strip 1.1, 2.1, whereas each sensor unit 6 comprises four temperature sensors 6.1.

Regarding the upper surface i.e. the grate and/or friction surface of the sealing strip 1.1, 2.1, the temperature sensors 6.1 comprise different distances. The distance between two consecutively mounted temperature sensors 6.1 is for example 2 mm. The sensor units consist of a circuit board 6.4, temperature sensors 6.1, and a microchip 6.2 with integrated radio module and a power supply via battery 6.3. The setting of the sealing strip 1.1, 2.1 next to the rotating roll shell 3 results in friction and thus in a rise in temperature on the sealing strip 1.1, 2.1. This rise in temperature leads to a change in resistance on the temperature sensors 6.1 positioned on the circuit board 6.4, whereas the temperature is determined via the voltage change caused by the programmed microchip 6.2. If a temperature sensor 6.1 is cut, i.e. destroyed, it results in a disruption of the signal. Thus the microchip 6.2 is able to calculate the exact sealing strip abrasion via the signal disruption in the individual temperature sensors 6.1.

On the outside of the suction roll a mini-server with radio module is positioned which receives data from the sensor units 6 via radio. The mini-server is preferably connected to a network and the data can be visualized via an output device such as a computer, tablet, laptop or mobile phone.

The sealing strip 1.1, 2.1 comprises of one sensor unit 6, preferably the sealing strip 1.1, 2.1 comprises several sensor units 6, in order to facilitate measurement of the temperature in several locations on the sealing strip 1.1, 2.1.

FIG. 2 shows an inventive sealing strip system 1, viewed in direction of travel of the roll shell 3, which is used preferably as the first sealing strip system 1 of a suction box 4 (not shown in FIG. 2; shown in FIG. 4). The sealing strip system 1 consists of a sealing strip 1.1, which is movably accommodated into the groove of the sealing strip mounting 1.2. An advancing tube 1.3, designed as a pressure tube is set into the groove below the sealing strip 1.1. In front of the sealing strip 1.1 is a sealing strip mounting 1.2 with a lubricant water system comprising spray nozzles 1.4 through which the lubricant water is inserted via a preferred spray tube integrated into the sealing strip mounting 1.2. Preferably at least one sensor unit 6 is integrated and/or inserted into the sealing strip 1.1. The advancing pressure, with which the sealing strip 1.1 is pressed against the inner wall of the roll shell 3, can be adjusted via the pressure in the advancing tube 1.3.

FIG. 3 shows an inventive sealing strip system 2, viewed preferably in direction of travel of the suction roll, which is used as second sealing strip system 2 of a suction box 4 (not shown in FIG. 3; shown in FIG. 4). The sealing strip system 2 consists of a sealing strip 2.1, which comprises a stop ridge along the lower front edge and which is accommodated movably in the groove of the sealing strip mounting 2.2. The groove contains an advancing tube 2.3 under the stop ridge of the sealing strip 2.1. The sealing strip mounting 2.2 comprises in front of the sealing strip 2.1 of a lubricant water system with spray nozzles 2.4 through which the lubricant water is inserted via a spray tube 2.5, integrated preferably into the sealing strip mounting 2.2.

Preferably at least one sensor unit 6 is integrated and/or inserted into the sealing strip 2.1. The advancing pressure with which the sealing strip 2.1 is pressed in the front area against the inner wall of the roll shell 3 can be adjusted via the pressure in the advancing tube 2.3. The sealing strip 2.1 comprises a curved upper surface, thus the upper surface in the front area rests against the roll shell 3 and a gradually increasing gab is formed with the roll shell 3 in the rear area. The width of this gap can be adjusted with a height adjustable strip 2.7, which can shift the rear end of the sealing strip 2.1 closer to the roll shell 3 or away from it. The height adjustable strip 2.7 is led along a stop ridge that leads upwards at an angle of a sliding strip 2.6 in longitudinal direction of the sealing strip 2.1. The sliding strip 2.6 can be designed as a sliding carriage that is slid into the groove of the sealing strip mounting 2.2 via a motor powered adjusting spindle.

A longitudinal displacement of the sliding strip 2.6 results in an upwards displacement of the height adjustable strip 2.7 along the groove. It is also possible to fixedly carry out the strip 2.6 and adjust its height along the groove by longitudinal displacement of the height adjustable strip 2.7. There are several possibilities to convert the rotation movement of the stepper motor into a linear movement of an actuating element, it should be noted that the distance of the rear end of the sealing strip 2.1 to the roll shell 3 is adjustable via a motor and can be held in the respective position.

The sealing strip mounting 2.2 contains preferably a symbolically illustrated sound sensor 7 and/or a pick-up which is used for measuring the noise level on and/or behind the sealing strip 2.1.

The inventive regulation method proposes the regulation of the opening angle of the gap between the sealing strip 2.1 and roll shell 3 in such a way that the noise level is reduced to a minimum.

In general, it should be noted that instead of pressure tubes 1.3, 2.3 other adjusting devices known to the state of the art can be used on the sealing strip 1.1 and the front end of the sealing strip 2.1. Thus, in addition to the pressure tubes it can comprise clamp devices for fixate the sealing strip in its position temporarily or after achieving a stable, optimal operation mode. Additionally, as known from EP0943729 B1, an additional pressure tube can exist which acts upon the sealing strip in opposite direction of the first pressure tube (advancing tube) in order to be able to "pull it away" from the roll shell.

With reference to FIG. 4, it is according to the invention also possible to provide an adjustment mechanism, such as used in the rear area of the sealing strip 2.1, for adjusting the sealing strip 1.1 and the front area of the sealing strip 2.1. The use of an advancing tube is hereby not mandatory. Since, contrary to the rear end of the sealing strip 2.1, its front area and the sealing strip 1.1 can be brought into contact with the roll shell 3, it is necessary to design the advancing pressure in a controllable or regulatable way. The advancing pressure can thus be regulated via a regulable holding torque of the motor or indirectly via a spring element which is located between the adjusting element and the sealing strip. If the sealing strip is already in contact with the roll shell, a force that is gradually increasing with increasing deformation of the spring element and with which the sealing strip is pressed against the roll shell can be applied via a further adjustment of the actuating element. It is advantageous that the actuating element is positioned in such a way that a small gap forms between sealing strip and roll shell.

FIG. 4 shows schematically the design of the suction box 4 with two inventive sealing strip systems 1, 2. The direction of travel of the roll shell 3 is indicated by an arrow. Viewed in direction of travel, the first front sealing strip system 1 is embodied according to FIG. 2, viewed from the direction of travel the second rear sealing strip system 2 is designed according to FIG. 3. FIG. 4 shows how both sealing strip systems 1, 2 form the lateral delimitation of the suction box 4. Thus inside the suction box 4 forms an area 4.1 which is sealed from the remaining interior of the suction roll.

As symbolically shown, the inside of the suction box 4 comprises a pressure sensor 5 for measuring the negative pressure and/or vacuum in the sealed area 4.1. Alternatively, the determination of the negative pressure in the suction box 4 can also occur in or through the vacuum pump which is used to create the vacuum in the sealed area 4.1.

The first sealing strip system 1 comprises a temperature sensor system 16 for determining the temperature in the sealing strip 1.1, which preferably consists in the embodiment of several sensor units 6 that are integrated into the sealing strip 1.1 according to FIG. 1.

The second sealing strip system 2 comprises a temperature sensor system 26 for determining the temperature in the sealing strip 2.1, which preferably consists in the embodiment of several sensor units 6 that are integrated into the sealing strip 2.1 according to FIG. 1. The second sealing strip system 2 comprises further a sensor for noise detection, which preferably consists in the embodiment of a sound sensor 7 integrated into the sealing strip mounting 2.2.

The first sealing strip system 1 comprises an adjusting mechanism to change position of the sealing strip 1.1, which preferably contains an advancing tube 1.3. The advancing pressure of the sealing strip 1.1 and/or the distance between sealing strip 1.1 and roll shell 3 is controllable and/or regulable via the adjustment mechanism. The first sealing strip system 1 comprises a lubricant water supply, whereas the amount of inserted lubricant water is controllable and regulable. The lubricant water supply consists preferably of an embodiment of a spray tube 1.5 integrated sealing strip mounting 1.2. The second sealing strip system 2 comprises an adjustment mechanism to change position of the front area of the sealing strip 2.1 which preferably contains an advancing tube. The advancing pressure of the front area of the sealing strip 2.1 and/or the distance between the front area of the sealing strip 2.1 and the roll shell 3 is controllable and/or regulable via the adjustment mechanism. The second sealing strip system 2 comprises a second adjustment mechanism for changing the position of the rear area of the sealing strip 2.1, which preferably comprises the stepper motor. The opening angle between the rear area of the sealing strip 2.1 and the roll shell 3 is controllable and/or regulable via the second adjustment mechanism.

The second sealing strip system 2 comprises a lubricant water supply, whereas the amount of inserted lubricant water is controllable and/or regulable. The lubricant water supply consists preferably of the embodiment of a spray tube 2.5 integrated into the sealing strip mounting 2.2.

The inventive adjustment method consists in a first embodiment in the determination of the negative pressure or vacuum in the suction box 4, whereas the advancing pressure or the distance to the roll shell 3 of the first sealing strip 1.1 and the advancing pressure or the distance to the roll shell 3 of the front area of the second sealing strip 2.1 are regulated in such a way that the minimal advancing pressure or the maximum distance is set, which is permissible in order to maintain the vacuum at the desired level inside the suction box 4. The advancing pressure or the distance can thereby be varied for both sealing strips 1.1, 2.1 together, for example by applying the same pressure to both pressure tubes 1.3, 2.3. A particular advantage of this inventive adjustment method is the minimization of the energy consumption of the roll, due to the fact that the vacuum is maintained with minimal advancing pressure, which results in high energy savings. It is also possible to separately regulate the advancing pressure or optionally the distance by applying determinable further control standards for both sealing strip 1.1, 2.1, for example by pressing the worn out strip with less force than the less worn out strip.

In the first embodiment of the adjustment method it preferably further comprises a temperature sensor system 16, 26 for detecting the sealing strip temperature of each sealing strip 1.1, 2.1. The amount of used lubricant water for sealing strip 1.1 is thereby controlled or regulated based on the measured values by the temperature sensor system 16 and the amount of used lubricant water for sealing strip 2.1 is thereby controlled or regulated based on the measured values by the temperature sensor system 26. The regulation of the lubricant water amount based on the temperature of the sealing strip 1.1, 2.1 can also be applied or is also preferable without the above mentioned regulation of the advancing pressure.

A particular advantage of this inventive control and/or regulation method is the minimization of water needs and thus considerably lower water consumption compared to conventional spray rubes.

In addition to the first embodiment, the second embodiment of the inventive regulation further comprises the measurement of the noise level after or on the second sealing strip system 2 and based on the measured values of the distance of the rear area of the sealing strip 2.1 to the roll shell 3 and with that the regulation of the opening angle of the gap between sealing strip 2.1 and roll shell 3, resulting in a minimal noise level. This method is also preferably applicable separately from the above described method, due to the noise development on conventional sealing strips, which reaches up to 110 dBA and thus constitutes a possible health hazard.

The invention provides that all measured values of all sensors are transmitted to a mini-server, preferably wireless, in which the regulation and control standards are stored, which can optionally be amended by a program or a user. Using the measured values, the min-server calculates the required adjustment variables for controlling the actuator. The mini-server is preferably connected to a display and input device, in particular wireless, in order to display the operation parameters and/or permit manual amendments.

A particularly advantage of the present invention is that the intelligent system ensures the most energy efficient and most noiseless operation possible and facilitates a preventative maintenance for controlling all important parameters within a suction roll, which is centrally monitored preferably via a miniserver and can be changed dependent on one another either by the system or by the user. The system is based on components with sensors such as in particular sealing strip, pressure tube, sealing strip mounting and spray tube, which preferably supply constant information about the process that prevents outside insight and/or outside control and provide thus information about the operation mode of the suction roll in singular form.

FIGS. 5, 6 and 7 shows schematically the supply of lubricant. At these figures, the sealing strip holder 1.2 has a plurality of openings 10, which, for example, are provided in the form of bores which are arranged at a distance from one another in the longitudinal direction of the sealing strip holder 1.2. The bores of the openings 10 run in such a way that an imaginary rectilinear extension leads them into the corner region between the sealing strip 1.1, 2.1 and the roll shell 3.

As shown in FIG. 5, the openings 10 can have a common supply channel 12, or as shown in FIG. 6, each be supplied with lubricating water via a separate supply channel 13.

As shown in FIG. 5, the supply channels 12 can be formed by recesses in the contact region of two adjacent parts of the sealing strip holder 1.2, for which a feed part 11 is inserted or screwed onto the actual sealing strip holder 1.2. As shown in FIGS. 2-4, the recesses can each be provided in a cross-sectional shape of a half circle in the actual sealing strip holder 1.2 and in the supply part 11 so that a spray tube 1.5, 2.5 can be inserted into this. Preferably, smaller pipes, which run in the openings 10 and/or have spray nozzles 1.4, 2.4 at the end, are preferably attached to the spray pipe 1.5, 2.5.

If the two parts 1.2, 11 are fastened sufficiently close to each other, the supply channel 12 resulting from the two recesses can also serve to supply the lubricating liquid.

The supply part 11 can be designed with hollow chambers, whereby the supply of the lubricant can take place up to the spray nozzles 1.4, 2.4 or the openings 10 exclusively in the supply part 11, as shown in FIG. 6.

As shown in FIG. 7, the sealing strip holder 1.2, 2.2 can also be designed as a single component, whereby the sealing strip holder 1.2, 2.2 has feeds, for example one or more bores in its longitudinal direction, whereby the openings 10 are formed by bores running normally to these. The sealing strip holder 1.2, 2.2 can also advantageously be designed as a hollow profile (for example extruded, whereby at least one chamber of the hollow profile is used for supplying lubrication water, for which purpose this chamber is preferably closed at one end of the hollow profile and is connected to a supply line 14 at the other end and the hollow profile is provided with openings 10, which lead in at least one as feed used chamber of the hollow profile. The chamber can also extend only over a partial region of the length of the opening of the hollow profile, for example by limiting the chamber on both sides by partition walls inserted into the opening. The connection of the supply line 14 can take place through an opening in one of the partition walls or through an opening from the sleeve surface of the hollow profile into the chamber.

Particularly preferred, the hollow profile is produced in a pultrusion procedure (also called pultrusion) and is thus a fiber reinforced plastic profile.

As shown in FIGS. 5, 6 and 7, the sealing strip holder 1.2, 2.2 preferably has a region running down to the sealing strip 1.1, 2.1 on its side facing the roll shell 3, which together forms a channel with the sealing strip 1.1, 2.1, via which excess lubricating water can flow off laterally in the longitudinal direction of the sealing strip holder 1.2, 2.2 in a controlled manner.

FIG. 8 shows an inventive sealing strip holder in the direction of movement of the roll shell 3 from the front. As shown in the left part of the figure, an opening 10 can each be supplied via its own supply channel 13, whereby each supply channel 13 has its own supply line 14, the flow rate of which can preferably be controlled or regulated by a valve 15. The openings 10 can be widened in the longitudinal direction of the sealing strip holder 1.2, 2.2 so that the fluid jet exiting from the openings 10 covers a larger length range of the sealing strip 1.1, 2.1.

As shown in the right part of the figure, a plurality of openings 10 can be fed from a common supply channel 12, whereby the common supply channel 12 having a supply line 14, the flow rate of which can preferably be controlled or regulated by a valve 15. The supply channels 12, 13 have at least one connection point for the supply line 14, whereby this, as shown in FIG. 8, is preferably located on at least one of the two end faces, preferably on the one end, to which the other connections is also for the pressure hoses or electrical connections, etc. The connection point may also be less preferred at another position of the sealing strip holder 1.2, 2.2, for example on the front or bottom side thereof.

The invention claimed is:

1. A sealing strip system for a suction roll, said system comprising:

at least one suction box located inside the roll shell of the suction roll;

two sealing strip systems configured to seal a suction zone against the inner side of the roll shell of the suction roll, each sealing strip system comprising:

a sealing strip holder and;

a sealing strip inserted in the sealing strip holder, wherein at least one of the sealing strip holders of the two sealing strip systems comprises a lubricant supply channel integrated in the body of the sealing strip holder and wherein at least one opening of the lubricant supply channel is located on an outer side of the sealing strip holder, wherein said outer side of the sealing strip holder is located in front of the sealing strip viewed in the direction of movement of the roll shell of the suction roll.

2. The sealing strip system according to claim 1, wherein said lubricant supply channel comprises a spray tube integrated into said sealing strip holder and said spray tube comprises a plurality of openings, from which spray tube several of said plurality of openings extend to said outer side of said sealing strip holder, wherein said outer side of said sealing strip holder is located in front of said sealing strip in the direction of movement of said roll shell.

3. The sealing strip system according to claim 1, wherein said lubricant supply channel is formed by at least one hollow chamber provided in said sealing strip holder and comprises a plurality of openings, from which hollow chamber several of said plurality of openings extend to said outer side of said sealing strip holder, which outer side of said sealing strip holder is located in front of said sealing strip (1.1, 2.1) in the direction of movement of said roll shell (3).

4. The sealing strip system according to claim 3, wherein said sealing strip holder comprises a hollow profile, whereby said hollow chamber is formed from an opening extending along the longitudinal direction through the hollow profile, or a partial region of this opening, whereby the opening or the part region of the opening is closed at least one end and has a connection for supplying lubricant.

5. The sealing strip system according to claim 1, wherein said at least one opening is provided in the form of a spray nozzle.

6. The sealing strip system according to claim 5, wherein said at least one opening is directed at the gap formed between the inner side of said roll shell and said sealing strip or their foremost contact line respectively.

7. The sealing strip system according to claim 1, wherein said at least one opening comprises a plurality of openings and several of said plurality of openings have a common lubricant supply channel.

8. The sealing strip system according to claim 1, wherein said at least one opening comprises a plurality of openings and at least a first of said plurality of openings or a first subgroup of said plurality of openings has a separate lubricant supply channel with respect to at least one second of said plurality of openings or a second subgroup of said plurality of openings.

9. The sealing strip system according to claim 1, wherein said sealing strip holder is constructed in two parts in the cross-section, whereby the first part serves to hold said sealing strip and the second part is designed as a feed part of said lubricant supply channel, wherein said second part comprises lubricant supply channels or forms lubricant supply channels together with said first part of said sealing strip holder at their common contact surface.

10. The sealing strip system according to claim 9, wherein the first part of said sealing strip holder and said feed part have recesses, which are adjacent to each other and together form said lubricant supply channels, when said feed part is mounted on the first part.

11. The sealing strip system according to claim 10, wherein a lubrication pipe is inserted in said lubricant supply channels.

12. The sealing strip system according to claim 11, wherein a lubrication pipe is a spray pipe.

13. The sealing strip system according to claim 1, wherein said sealing strip holder has a region running downwards towards said sealing strip on its side facing the inner side of said roll shell such that said region forms a channel via which excess lubricating water can flow off laterally in the longitudinal direction of the sealing strip holder.

14. The sealing strip system according to claim 1, wherein a supply line is arranged on one of the two end faces of said sealing strip holder for said lubricant supply channel, or for each supply channel of said lubricant supply channel.

15. The sealing strip system according to claim 14, wherein each of said supply lines has a device for flow control or regulation.

16. The sealing strip system according to claim 15, wherein the device is controllable for flow control or regulation as a function of the sealing strip temperature.

17. The sealing strip system according to claim 16, wherein a plurality of temperature sensors, which are spaced apart from one another in the longitudinal direction of said sealing strip, are integrated in said sealing strip.

18. The sealing strip system according to claim 15, wherein said device for flow control or regulation comprises a valve.

19. A sealing strip system for a suction roll, said system comprising:

at least one suction box configured for location inside the roll shell of the suction roll;

two sealing strip systems configured to seal a suction zone against the inner side of the roll shell of a rotating suction roll, each sealing strip system comprising:

a sealing strip holder and;

a sealing strip, which is inserted in the sealing strip holder, wherein at least one of the sealing strip holders of the two sealing strip systems comprises a lubricant supply channel within the body of the sealing strip holder and wherein at least one opening of the lubricant supply channel is located on an outer side of the sealing strip holder, which outer side of the sealing strip holder is located in front of the sealing strip viewed in the direction of movement of the roll shell of the suction roll.

20. A suction roll comprising the sealing strip system of claim 19.

* * * * *